US005390392A

United States Patent [19]

Thomas et al.

[11] Patent Number: 5,390,392

[45] Date of Patent: Feb. 21, 1995

[54] VACUUM CLEANER BAG COVER WITH ENLARGED ACCESS OPENING

[75] Inventors: Joyce K. Thomas; Michael R. Oetting, both of Lexington; Joseph L. Mulcahy, Bloomington, all of Ill.

[73] Assignee: White Consolidated Industries, Inc., Cleveland, Ohio

[21] Appl. No.: 62,774

[22] Filed: May 17, 1993

[51] Int. Cl.[6] ..... A47L 9/14

[52] U.S. Cl. ..... 15/339; 15/350; 15/351; 55/371

[58] Field of Search ..... 15/350, 351, 339, 347; 55/369, 370, 371

[56] References Cited

U.S. PATENT DOCUMENTS

| | | | |
|---|---|---|---|
| 1,513,395 | 5/1923 | Holmes . | |
| 1,871,024 | 8/1932 | Barber | 55/371 |
| 2,003,720 | 2/1933 | Meek . | |
| 2,176,467 | 10/1939 | Milner et al. | 55/369 X |
| 2,224,094 | 12/1940 | Small | 55/369 |
| 4,342,575 | 8/1982 | Scott . | |
| 4,566,884 | 1/1986 | Jones et al. . | |
| 4,621,390 | 11/1986 | Hampton et al. . | |
| 4,670,030 | 6/1987 | Schultz . | |
| 4,709,443 | 12/1987 | Bigley . | |

*Primary Examiner*—Christopher K. Moore
*Attorney, Agent, or Firm*—Pearne, Gordon, McCoy & Granger

[57] ABSTRACT

The present invention is directed towards a vacuum cleaner bag cover which provides an enlarged access opening into the interior thereof. The vacuum cleaner bag, which is designed to enclose a removable dirt filtering and collecting bag, includes a main section and a front panel section. In a first embodiment, the front panel section is connected to the main section by a pair of parallel, vertically oriented zippers and a top member which snap-fits over the top of the main section. In a second embodiment, the front panel section is permanently attached to the main section along one edge, and releasably attached at an opposite edge by a vertically-oriented zipper. An interior frame is provided to vertically support the vacuum cleaner bag cover. In the first embodiment, access to the interior of the vacuum cleaner bag cover is gained by sliding the zippers downwardly, pulling the bag cover top member off the vacuum cleaner bag cover and folding the front panel section downwardly. In the second embodiment, access to the interior of the vacuum cleaner bag cover is gained by sliding the zipper downwardly, pulling the bag cover top member off the vacuum cleaner bag cover, and folding the front panel section outwardly away from the zipper. The front panel section can be formed of either air permeable or impermeable material, allowing for a variety of material combinations in the vacuum cover bag.

22 Claims, 4 Drawing Sheets

VACUUM CLEANER BAG COVER WITH ENLARGED ACCESS OPENING

BACKGROUND OF THE INVENTION

1. Field of the Invention

The present invention relates generally to vacuum cleaners, and, more particularly, to vacuum cleaner bag covers.

2. Description of the Related Art

During the development of upright vacuum cleaners, several structural features have become common. Of these, the structure of the vacuum cleaner bag cover which encloses the replaceable dirt retaining bag or vessel has become almost universal in design.

Traditionally, the vacuum cleaner bag cover is suspended from the handle of the vacuum cleaner and provides a single vertically oriented zipper along either a front, back or lateral side thereof. The zipper allows the user to gain access into the interior of the bag cover for removal or replacement of the dirt-filtering bag therein. Although different bag supporting structures have been proposed over the years, the single zipper vacuum cleaner bag cover has remained the standard in the vacuum cleaner art.

With these known types of vacuum cleaner bag covers, when the removable bag or vessel enclosed within the vacuum cleaner bag cover is to be emptied or replaced, access and removal is difficult due to the limited opening space provided by the single zipper. The removable bag is typically similar in size to the opening provided by the zipper, making removal of the bag, and insertion of a new bag, difficult.

Therefore, there exists a need in the art for a vacuum cleaner bag cover which provides an enlarged closeable access opening to ease the removal and replacement of the bag housed therein.

SUMMARY OF THE INVENTION

The present invention is directed towards a vacuum cleaner bag cover which provides an enlarged access opening. The vacuum cleaner bag cover is adapted to enclose a removable inner bag and includes a main section, a front panel section, and attachment means. The attachment means are operable to releasably attach the front panel section to the main section, the front panel section being partially detachable from the main section to gain access to the removable inner bag.

According to one embodiment of the present invention, the attachment means include a pair of parallel zippers which attach opposite edges of the front panel section to the main section. A top of the front panel section includes a bag cover top which snap fits over the top of the vacuum cleaner bag cover.

According to a second embodiment of the present invention, the attachment means include a single zipper which attaches an edge of the front panel section to the main section. A top of the front panel section includes a bag cover top which snap fits over the top of the vacuum cleaner bag cover.

BRIEF DESCRIPTION OF THE DRAWINGS

These and further features of the present invention will be apparent with reference to the following description and drawings, wherein.

DETAILED DESCRIPTION OF THE PREFERRED EMBODIMENT

Figure 1:
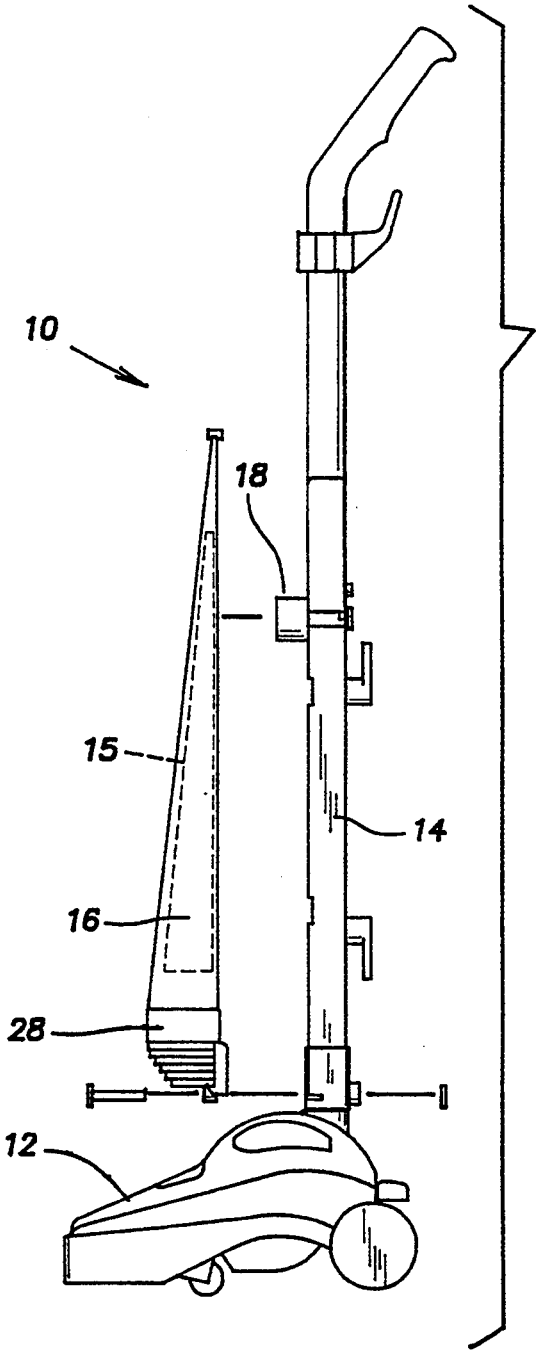
FIG. 1 is an exploded side elevational view of an upright vacuum cleaner in accordance with the present invention.

With reference to FIG. 1, a vacuum cleaner 10 in accordance with the present invention is shown. The vacuum cleaner 10 includes a floor engaging unit 12, a pivotal handle 14, and an outer vacuum cleaner bag cover 16. Dirt-laden air is forced through the floor engaging unit 12 and handle 14 and into a removable inner bag 15 which is enclosed by the vacuum cleaner bag cover 16. The inner bag 15 mounts over a cylindrical projection 18 which extends outwardly from the handle 12 into an interior of the vacuum cleaner bag cover 16.

Figure 2:
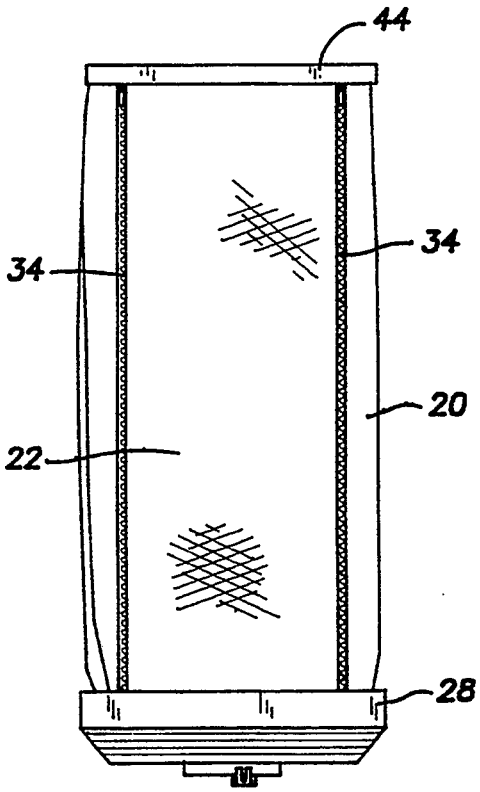
FIG. 2 is a front elevational view of the two zipper bag in accordance with a first embodiment of the present invention.
Figure 3:
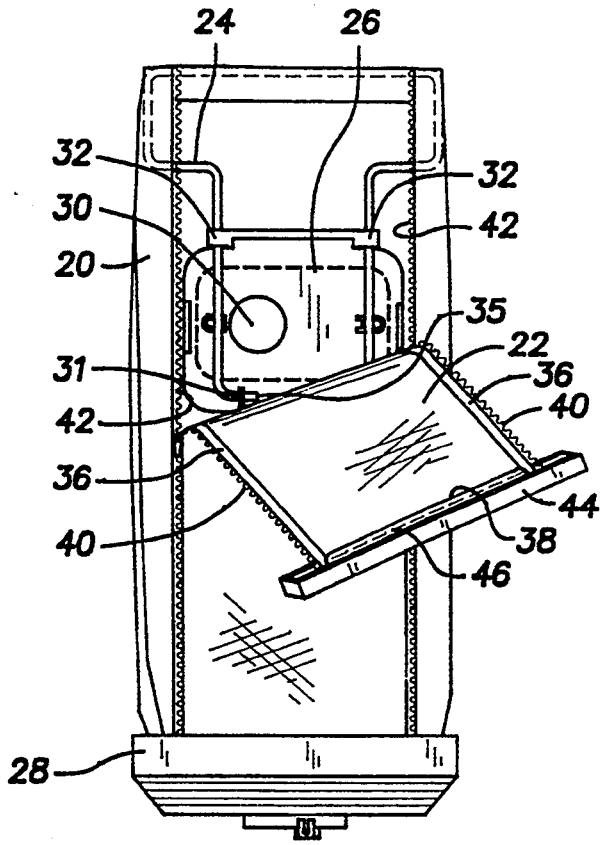
FIG. 3 is a front elevational view of the two zipper bag of FIG. 2 with the bag partially opened; and, FIG. 4 is a perspective view of the baseplate, support frame, and a portion of the vacuum cleaner bag cover in accordance with the present invention.
Figure 4:
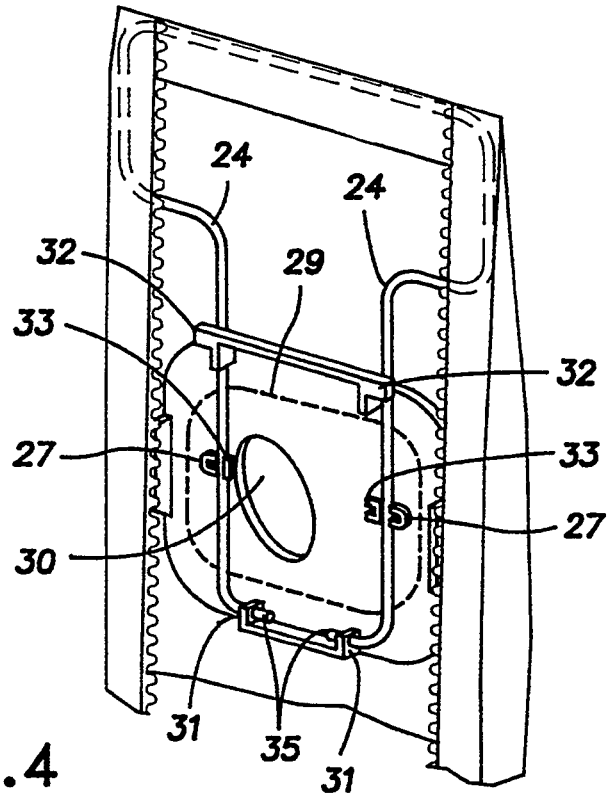

Turning to FIGS. 2–4, the vacuum cleaner bag cover of the present invention is specifically shown to include a main section 20, a rectangular front panel section 22, a supporting frame 24, a baseplate 26, and a lower bag member 28. The rectangular front panel section 22 generally matches the dimensions of a rectangular opening in the main section 20, and is removably attached to the main section, as will be described more fully hereafter.

The lower bag member 28 is attached to the handle 14 and provides an upwardly directed rectangular opening for the receipt of the main section 20 and the front panel section 22. The lower bag member 28 is formed of rigid plastic to aid in retaining the main section's shape and to assist in mounting the main section and front panel section thereto. Preferably, the main section 20 and front panel section 22 are permanently attached to the lower bag member 28.

Whereas the main section 20 is normally formed of soft, air-permeable fabric, the front panel section 22 can be formed of either air permeable or air impermeable material. For example, the front panel section 22 can be made of an air impermeable flexible plastic conducive to the placement of intricate graphics or text thereon. Alternatively, the front panel section 22 could be formed of a different air permeable material than the main section 22. It is also contemplated that the main section 20 and the front panel section 22 can be formed of a single continuous piece of air-permeable fabric. In such a construction, a lower or bottom portion of the front panel section 22, which is concealed by the lower bag member 28 in the drawing figures, would be integral with the main section 20. The front panel section 22 can also be adapted to receive flexible cards which would provide information or operating instructions pertinent to the particular host vacuum cleaner model.

Therefore, it should be clear that regardless of the specific material used, the rectangular front panel section 22 advantageously allows a different material to be used in the front panel section 22 than was used in the main section. Specifically, wherein the main section 20 is generally required to be formed of an air permeable material, the front panel section 22 of the bag cover 16 of the present invention can be formed of either an air permeable or an air impermeable material, allowing a variety of materials to be used on vacuum cleaner bag covers which were heretofore not useable.

The cylindrical projection 18 extends through an aperture in the vacuum cleaner bag cover and into the baseplate 26. As shown best in FIG. 4, the baseplate 26, which includes an offset opening 30 for the receipt of the cylindrical projection 18, is attached to the vacuum cleaner bag cover by means of a plurality of sewn stitches 29. The baseplate 26 includes a pair of fastener receiving bosses 27 which align with openings (not shown) on the handle, allowing the baseplate 26 to be attached to the handle by means of conventional fasteners (not shown). The baseplate 26 also includes a plurality of mounting projections 31, a mounting member 32, and raised ribs 33 to aid in attaching the support frame thereto.

The support frame 24, which is preferably formed of wire, includes a pair of inwardly directed ends 35, each of which extend through one of the mounting projections 31 provided by the baseplate 26. The support frame 24 is removably trapped, due to the inherent elasticity of the wire frame, between the mounting projections 31, the mounting member 32, the ribs 33, and the fastener receiving bosses 27 provided by the baseplate 26. The support frame 24 extends upwardly and outwardly from the baseplate 26 around the upper inside perimeter of the vacuum cleaner bag cover 16, as illustrated in FIGS. 3 and 4.

For a more detailed description of the operation of the vacuum cleaner and the manner in which the vacuum cleaner bag cover 16 is attached to the handle 14 and supported by the frame 24, reference should be made to the commonly assigned U.S. patent application Ser. No. 07/962,412, which was filed on Oct. 16, 1992, the disclosure of which is expressly incorporated herein by reference.

As shown best in FIGS. 2 and 3, in the first embodiment of the present invention the front panel section 22 and the main section 20 are releasably attached by a pair of parallel zippers 34. The front panel section 22 includes a pair of lateral edges 36 and an upper edge 38. Each of the lateral edges 36 have a row of teeth 40 which mesh with like rows of teeth 42 on the main section 20 to form the zipper 34.

The upper edge 38 of the vacuum cleaner bag cover 16 is sewn or otherwise permanently attached to a bag cover top member 44. The bag cover top member 44, which is preferably formed of rigid plastic, includes a downwardly extending tab 46 and a series of mounting members (not shown). The downwardly extending tab 46 is sewn or otherwise permanently attached to the upper edge 38 of the front panel section 22. The mounting members provided by the bag cover top member 44 cooperate to allow the cover top member 44 to snap fit over the top of the main section 20, and the top of the support frame 24 therebeneath.

Hence, in the first embodiment of the present invention, when access to the interior of the vacuum cleaner bag cover 16 is desired, the pair of zippers 36 are pulled downwardly, the bag cover top member 44 is pulled off the main section 20, and the front panel section is folded downwardly, as depicted in FIG. 3. Thereafter, when access to the interior of the vacuum cleaner bag cover 16 is no longer desired, the bag cover top member 44 is snapped onto the main section 20 and the zippers 36 are pulled upwardly.

Figure 5:
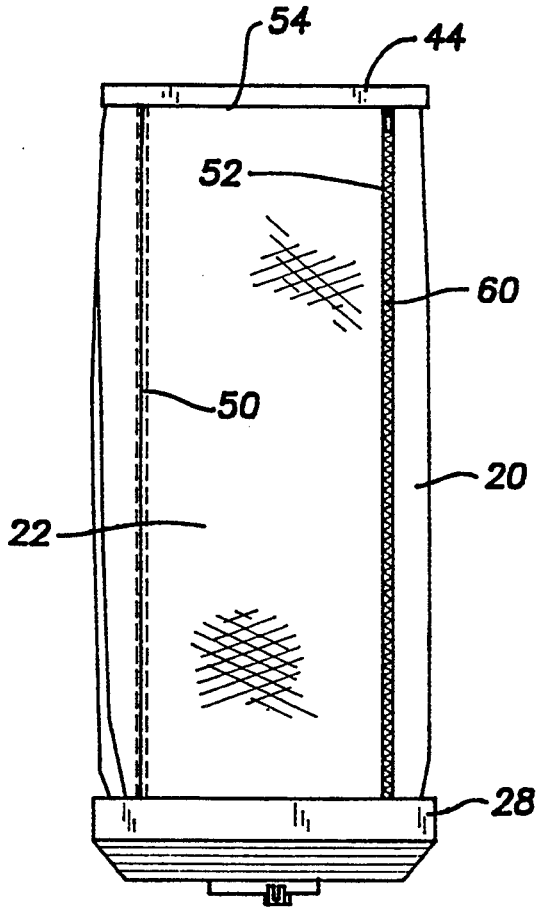
FIG. 5 is a front elevational view of the single zipper bag in accordance with a second embodiment of the present invention.
Figure 6:
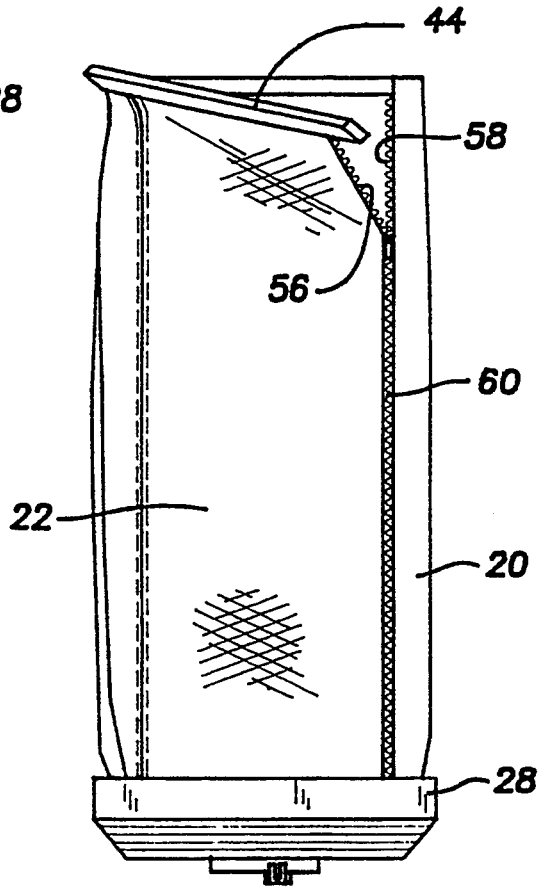
FIG. 6 is a front elevational view of the single zipper bag of FIG. 5, with the bag partially open; and, FIG. 7 is a front elevational view of the single zipper bag of FIG. 5, with the bag completely open.
Figure 7:
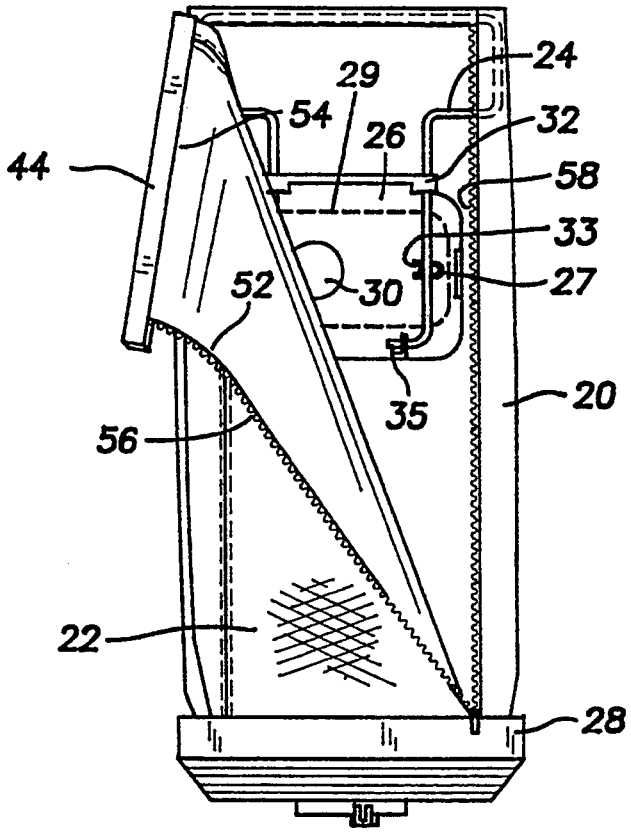

FIGS. 5–7 illustrate a second embodiment of the present invention wherein a single zipper is employed. As in the first embodiment, the vacuum cleaner bag cover 16 includes a main section 20, a rectangular front panel section 22, a supporting frame 24, a baseplate 26, a lower bag member 28, and a bag cover top member 44. The supporting frame 24, baseplate 26, lower bag member 28, and bag cover top member 44 are generally identical to that described previously with respect to the first embodiment and will not be further described herein.

The front panel section 22 includes first and second lateral edges 50, 52 and an upper edge 54. The first lateral edge 50 is sewn or otherwise permanently attached to the main section 20. The second lateral edge 52 includes a row of teeth 56 which mesh with a like row of teeth 58 on the main section 20 to form a zipper 60. As in the first embodiment, the upper edge 54 of the front panel section 22 is sewn or otherwise permanently attached to the bag cover top member 44.

It should be clear from the foregoing that, instead of permanently attaching one edge of the front panel section to the main section, the main section 20 and front panel section 22 could be formed as a single continuous or integral piece of fabric. In this fashion, the zipper 60 would be employed to close or attach the opposite ends of the fabric identically to the way the present zipper attaches one lateral edge of the front panel section to the main section.

Hence, in the second embodiment of the present invention, when access to the interior of the vacuum bag cover 16 is desired, the zipper 60 is pulled downwardly a short distance and the bag cover top member 44 is pulled off the main section 20, as depicted in FIG. 6. Thereafter, the zipper 60 is pulled down the rest of the way, and the front panel section 22 is folded outwardly away from the zipper 60 to allow access to the interior of the bag cover 16, as shown in FIG. 7. Alternatively, the zipper 60 can be pulled all of the way down to the bottom of the bag cover 16 (i.e., the position shown in FIG. 7), the bag cover top member 44 pulled off the main section, and the front panel section 22 folded outwardly away from the zipper to allow access to the interior of the bag cover 16.

When access to the interior of the bag 16 is no longer desired, the zipper 60 is moved to the position shown in FIG. 6, the top member 44 is snapped onto the main section 20, and the zipper 60 is pulled the rest of the way up, generally returning the bag cover 16 to the condition depicted in FIG. 5.

The foregoing description is illustrative of the preferred embodiment of the invention presently contemplated by the inventor, and is not to be construed in a limitative manner. It should be clear that numerous modifications can be made without departing from the scope and spirit of the present invention.

For example, the zippers could be replaced by a different attachment means, such as Velcro®, snaps or magnetic closures. Also, the front panel section could be attached to the main section by a single zipper which has an inverted "U"-shaped path of travel instead of the snap-on bag top member and pair of vertically directed zippers. Moreover, although throughout the application the vacuum cleaner bag cover is referred to as enclosing a removable bag, it is clear that any type of dirt receptacle could be received within the vacuum cleaner bag cover.

Also, the terms "main section" and "front panel section" used herein are merely intended to refer to or indicate different elements or components of the vacuum cleaner bag cover 16, and in way are meant to define the bag cover as being composed of more than one material or fabric. Rather, as stated hereinbefore, the front panel section 22 and main section 20 can be formed of a single continuous piece of air-permeable fabric, or, alternatively, can be formed of different materials. Therefore, the scope of the present invention is not limited to a specific fabric or combination of fabrics recited herein, but rather encompasses the use of all materials to create the vacuum cleaner bag cover described in the claims appended hereto.

What is claimed is:

1. A vacuum cleaner comprising a floor engaging section, a handle extending upwardly from said floor engaging section, and a vacuum cleaner bag cover attached to said handle, said vacuum cleaner bag cover being adapted to enclose a removable inner bag and comprising a main section, a front panel section, and attachment means, said front panel section being formed of a different air permeable material than said main section and including a pair of lateral edges and an upper edge, wherein said upper edge and at least one of said lateral edges are releasably attached to the main section by the attachment means to allow the front panel section to partially detach from the main section and thereby provide access to an interior of the vacuum cleaner bag cover.

2. A vacuum cleaner according to claim 1, wherein the attachment means includes a bag cover top member, said bag cover top member being permanently attached to the upper edge and releasably attached to the main section.

3. A vacuum cleaner according to claim 2, wherein the attachment means comprises a zipper, said zipper having a first row of teeth attached to one of the lateral edges of the front panel section and a second row of teeth attached to the main section, said first and second rows meshingly engaging to releasably attach the front panel section to the main section.

4. A vacuum cleaner according to claim 2, wherein the attachment means comprises a pair of zippers, each of said zippers having a first row of teeth attached to one of the lateral edges of the front panel section and a second row of teeth attached to the main section, said first and second rows meshingly engaging to releasably attach the front panel section to the main section.

5. A vacuum cleaner according to claim 4, wherein the front panel section is air impermeable and the main section is air permeable.

6. A vacuum cleaner according to claim 2, wherein a first of the pair of lateral edges is permanently attached to the main section and a second of the pair of lateral edges is releasably attached to the main section by the attachment means.

7. A vacuum cleaner according to claim 6, wherein the attachment means comprises a zipper, said zipper having a first row of teeth attached to the second lateral edge of the front panel section and a second row of teeth attached to the main section, said first and second rows meshingly engaging to releasably attach the front panel section to the main section.

8. A vacuum cleaner according to claim 7, wherein the front panel section is air impermeable and the main section is air permeable.

9. A vacuum cleaner bag cover, said vacuum cleaner bag cover being adapted to enclose a removable inner bag and including support means mounted in said vacuum cleaner bag to support said inner bag, a main section, and a front panel section, said main section having an open front which is releasably covered by said front panel section, said front panel section including a pair of lateral edges and an upper edge, wherein said front panel section and said main section include attachment means to releasably attach the lateral edges of the front panel section to the main section, said front panel section being at least partially detached from the main section to gain access to an interior of the vacuum cleaner bag cover.

10. A vacuum cleaner bag cover according to claim 9, wherein said attachment means includes a bag cover top member, said bag cover top member being attached to the upper edge of the front panel section and being adapted to snap fit over an upper portion of the main section.

11. A vacuum cleaner bag cover according to claim 10, wherein at least one of the lateral edges provide a first row of teeth which mesh with a second row of teeth provided by the main section to thereby form a zipper and releasably attach the front panel section to the main section.

12. A vacuum cleaner according to claims 10, wherein each of the lateral edges provide a row of teeth which meshingly engage a like row of teeth provided by the main section to releasably attach the front panel section to the main section.

13. A vacuum cleaner bag cover according to claim 12, wherein the supporting means comprises a baseplate and a wire frame, said frame and baseplate cooperating to vertically support the vacuum cleaner bag cover.

14. A vacuum cleaner bag cover according to claim 13, wherein the front panel section is air impermeable and the main section is air permeable.

15. A vacuum cleaner bag cover, said vacuum cleaner bag cover being adapted to enclose a removable inner bag and including support means mounted in said vacuum cleaner bag to support said inner bag, attachment means, a main section, and a front panel section, said main section having an open front which is releasably covered by said front panel section, said front panel section being formed of a different air permeable material than said main section, and including first and second lateral edges and an upper edge, wherein said first lateral edge is permanently attached to the main section and said second lateral edge is releasably attached to the main section by the attachment means, said front panel section being at least partially detached from the main section to gain access to an interior of the vacuum cleaner bag cover.

16. A vacuum cleaner bag cover according to claim 15, wherein said attachment means includes a bag cover top member, said bag cover top member being attached to the upper edge of the front panel section and being adapted to snap fit over an upper portion of the main section.

17. A vacuum cleaner bag cover according to claim 16, wherein the second lateral edge provides a first row of teeth which mesh with a second row of teeth provided by the main section to thereby form a zipper and releasably attach the front panel section to the main section.

18. A vacuum cleaner bag cover according to claim 17, wherein the supporting means comprises a baseplate and a wire frame, said frame and baseplate cooperating to vertically support the vacuum cleaner bag cover.

19. A vacuum cleaner bag cover according to claim 18, wherein the front panel section is air impermeable and the main section is air permeable.

20. A vacuum cleaner comprising a floor engaging section, a handle extending upwardly from said floor engaging section, and a vacuum cleaner bag cover attached to said handle, said vacuum cleaner bag cover being adapted to enclose a removable inner bag and comprising a main section, a front panel section, and attachment means, said front panel section including a pair of lateral edges and an upper edge, said attachment means including a bag cover top member, said bag cover top member being permanently attached to the upper edge and releasably attached to the main section, said attachment means further comprising a pair of zippers, each of said zippers having a first row of teeth attached to one of the lateral edges of the front panel section and a second row of teeth attached to the main section, said first and second rows meshingly engaging to releasably attach the front panel section to the main section.

21. A vacuum cleaner according to claim 21, wherein the front panel section is air impermeable and the main section is air permeable.

22. A vacuum cleaner comprising a floor engaging section, a handle extending upwardly from said floor engaging section, and a vacuum cleaner bag cover attached to said handle, said vacuum cleaner bag being adapted to enclose a removable inner bag and comprising a main section, a front panel section, and attachment means, said front panel section including a pair of lateral edges and an upper edge, said attachment means including a bag cover top member, said bag cover top member being permanently attached to the upper edge and releasably attached to the main section, a first of the pair of lateral edges is permanently attached to the main section and a second of the pair of lateral edges is releasably attached to the main section by the attachment means, said attachment means further comprising a zipper, said zipper having a first row of teeth attached to the second lateral edge of the front panel section and a second row of teeth attached to the main section, said first and second rows meshingly engaging to releasably attach the front panel section to the main section, said front panel section being air impermeable and the main section being air permeable.

* * * * *

UNITED STATES PATENT AND TRADEMARK OFFICE

CERTIFICATE OF CORRECTION

PATENT NO. : 5,390,392

DATED : February 21, 1995

INVENTOR(S) : Joyce K. Thomas Et al.

It is certified that error appears in the above-identified patent and that said Letters Patent is hereby corrected as shown below:

Column 6, line 32, "claims" should read --claim--.

Colume 8, line 3, "21" (second occurance) should read --20--.

Signed and Sealed this

Sixth Day of June, 1995

*Attest:*

Bruce Lehman

BRUCE LEHMAN

*Attesting Officer*

*Commissioner of Patents and Trademarks*